US006849971B1

(12) United States Patent
Anger et al.

(10) Patent No.: US 6,849,971 B1
(45) Date of Patent: Feb. 1, 2005

(54) DRIVE DEVICES FOR INTERRUPTER UNITS IN POWER SUPPLY AND DISTRIBUTION SWITCHGEAR

(75) Inventors: Nils Anger, Berlin (DE); Andreas Stelzer, Berlin (DE); Hartmut Schoentag, Hohen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/647,624

(22) PCT Filed: Mar. 19, 1999

(86) PCT No.: PCT/DE99/00889

§ 371 (c)(1),
(2), (4) Date: Dec. 5, 2000

(87) PCT Pub. No.: WO99/50869

PCT Pub. Date: Oct. 7, 1999

(30) Foreign Application Priority Data

Mar. 31, 1998 (DE) ..... 198 15 538

(51) Int. Cl.[7] ..... H01H 33/66

(52) U.S. Cl. ..... 310/30; 218/140; 335/172; 200/400

(58) Field of Search ..... 218/118, 154, 218/120, 140, 145; 335/14, 20, 30, 172, 174; 361/151, 152, 154; 200/329, 400, 402; 310/13, 14, 30

(56) References Cited

U.S. PATENT DOCUMENTS

| | | | | |
|---|---|---|---|---|
| 3,359,464 A | | 12/1967 | Henderson | 335/68 |
| 4,858,452 A | * | 8/1989 | Ibrahim | 70/275 |
| 4,970,423 A | * | 11/1990 | Tamae et al. | 310/162 |
| 5,191,180 A | * | 3/1993 | Kitamura et al. | 218/135 |
| 5,284,076 A | * | 2/1994 | Fritz et al. | 82/118 |
| 5,354,960 A | | 10/1994 | Erickson | 200/400 |
| 5,654,598 A | * | 8/1997 | Horski | 310/67 R |
| 5,777,402 A | * | 7/1998 | Chitayat | 310/12 |
| 5,969,957 A | * | 10/1999 | Divan et al. | 363/36 |
| 5,990,583 A | * | 11/1999 | Nanba et al. | 310/12 |
| 6,291,911 B1 | * | 9/2001 | Dunk et al. | 307/137 |
| 6,331,687 B1 | * | 12/2001 | Dunk et al. | 218/140 |

FOREIGN PATENT DOCUMENTS

| | | |
|---|---|---|
| DE | 2 244 793 | 3/1974 |
| DE | 24 17 236 | 11/1975 |
| DE | 26 18 201 | 10/1977 |
| DE | 32 24 165 | 12/1983 |
| DE | 43 04 921 | 8/1994 |
| DE | 296 20 438 | * 1/1997 |

OTHER PUBLICATIONS

Translation of DE 296 20 438 U1*
Translation of DE 2 244 793.*
Von Edgar Dullni, et al., "Neu: Vakuumleistungsschalter mit permanent–magnetischem Antrieb", Elektrizitätswirtschaft, vol. 96 (1997), Issue 21, pp. 1205–1208** (month unknown).

* cited by examiner

*Primary Examiner*—Thanh Lam
*Assistant Examiner*—Judson H. Jones
(74) *Attorney, Agent, or Firm*—Kenyon & Kenyon

(57) ABSTRACT

Drive devices for switchgear interrupter units, having movable contact pieces that can be controlled by solenoid drives are described. The drives of the movable contact pieces being controllable by linear motor drives. The interrupter units are realized by vacuum circuit breakers, and the linear motor drives are realized by three-phase AC linear motors. Each of these can be influenced by a control unit that optimizes the switching operations and that is provided with a mains connection. The three-phase AC linear motors are composed of individual components that determine thrust and range of motion. The individual components together constitute the drive of the movable contact parts. The individual components are determined by the number of motor coils and/or by the number of parallel motor modules.

2 Claims, 1 Drawing Sheet

DRIVE DEVICES FOR INTERRUPTER UNITS IN POWER SUPPLY AND DISTRIBUTION SWITCHGEAR

FIELD OF THE INVENTION

The present invention relates to drive devices for switchgear interrupter units, having movable contact pieces that can be controlled by solenoid drives. The drives of the movable contact pieces are controllable by linear motor drives.

BACKGROUND INFORMATION

Drive devices of the type mentioned above are described in German Patent No. 22 44 793. Here, the interrupter units are realized by the contact pins of low-oil-content circuit breakers, whose movable contact pins in a three-pole embodiment are driven in common by one linear motor.

Further drive devices of the type mentioned above are described in the publication, "Electricity Power Supply, Vol. 96 (1997), Issue 21, pp. 1205 through 1208. Conventional spring mechanisms for the interrupter units, which are made up of a great number of individual mechanical elements, are here replaced by a less expensive, permanently magnetized drive. The movable contact piece of the interrupter unit—here executed as a power switch within a vacuum chamber—is deflected vertically by a so-called coupling shank, the coupling shank being connected to a lever shaft that is coupled from the magnetic drive. The lever shaft is connected to one end of the coupling shank of the interrupter unit, whereas the other end of the coupling shank is controlled by the armature of the magnetic drive. The lifting force of the magnetic drive for actuating the movable contact piece of the interrupter unit is therefore deflected by the lever shaft such that inside the interrupter unit there is a re-deflection in the vertical direction.

In addition to the permanent magnet and the movable armature, the magnetic drive has a closing coil and an opening coil, the closing coil and the opening coil having the sole function of performing a switchover, whereas the generation of retention forces is only achieved by the permanent magnets.

SUMMARY

An object of the present invention is to make it easier to adjust the design of drive devices to the movable contact parts of varying circuit breakers, requiring various thrusts and ranges of motion. In addition, the interrupter units themselves are to be configured as compact functional units.

According to an example embodiment of the present invention, this object is achieved by proving the following features:

1.1 the interrupter units are realized by vacuum circuit breakers, 1.2 the linear motor drives are realized by three-phase AC linear motors, each of which can be influenced by a control unit that optimizes the switching operations and that is provided with a mains connection, 1.3 the three-phase AC linear motors are made of individual components that determine thrust and range of motion, the individual components together constituting the drive of the movable contact parts, and 1.4 the individual components are determined by the number of motor coils and/or by the number of parallel motor modules.

If three-phase AC linear motors are used for the drive of the interrupter units, then the kinematic demands for actuating the movable contact parts of vacuum circuit breakers are significantly simplified because the necessary thrusts and ranges of motion can be determined by the differing configuration of the individual components. The conventional linear motors, in contrast to the three-phase AC linear motors, do not have any individual components determining thrust and range of motion, that might realize comparable possibilities for adjusting the vacuum circuit breakers.

One advantageous embodiment of the present invention provides the following features:

2.1 the interrupter units and the linear motor drives having the control units are arranged in a common gas compartment, and 2.2 the mains connection is supplied to the gas compartment via a gas-tight lead-in wire.

As a result of these measures, the interrupter units can be executed overall as compact functional units.

In a further advantageous embodiment of the present invention, the following features are provided:

3.1 the linear motor drives are an integral component of the interrupter units, and 3.2 the control units are an integral component of the linear motor drives.

In this way, a further increase in the degree of compactness is achieved for the interrupter units.

DETAILED DESCRIPTION

Figure 1:
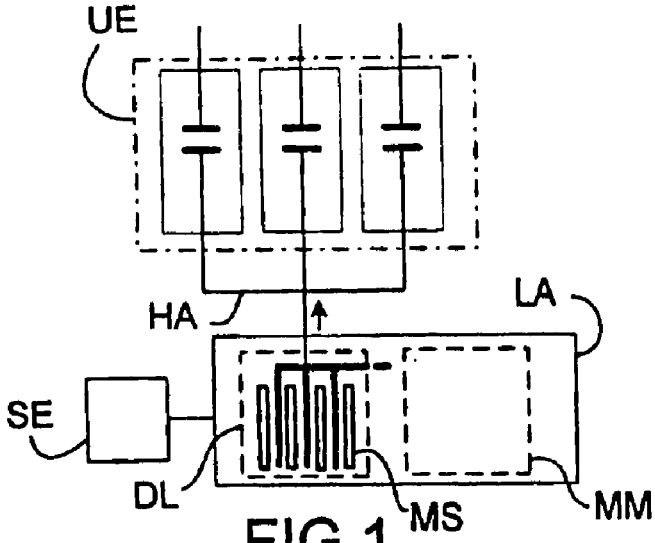
FIG. 1 depicts an interrupter unit having three vacuum switches which are controlled by a common linear drive.

FIG. 1 shows interrupter unit UE having three vacuum switches, whose movable contact pieces are actuated by linear motor drive LA via common lever arrangement HA in the range of motion indicated by the arrow. In addition, it is indicated that linear motor drive LA is realized by three-phase AC linear motor DL, whose range of motion brings about the actuation of lever arrangement HA directly from motor coils MS. Depending on the thrust required and the range of motion necessary, the number of motor coils MS and/or the number of motor modules MM in the linear motor drive can be adjusted accordingly. Linear motor drive LA is connected to control unit SE, which optimally controls the motion sequences, relevant to the physical switching processes, of the movable contact pieces of interrupter units UE.

Figure 2:
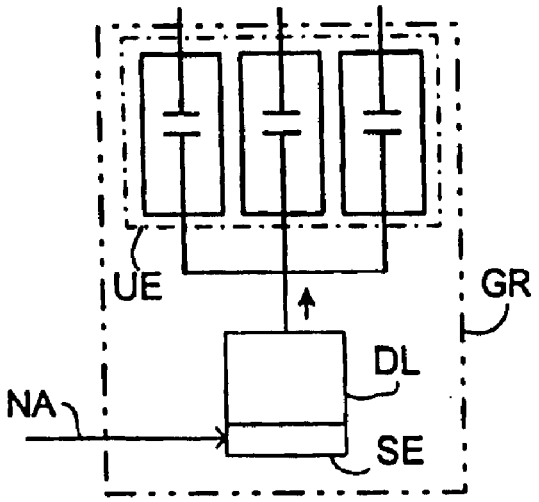
FIG. 2 depicts the interrupter unit together with a three-phase AC linear motor in a common gas compartment.

FIG. 2 depicts a further exemplary embodiment of the present invention, in which interrupter unit UE together with three-phase AC linear motor DL and control unit SE are accommodated in gas compartment GR. Necessary mains connection NA for the control unit is brought directly into gas compartment GR by a conventional gas-tight lead-in wire (not shown). The individual components in gas compartment GR, in a conventional manner, can be given correspondingly smaller design dimensions for the realization of the identical power requirements.

Figure 3:
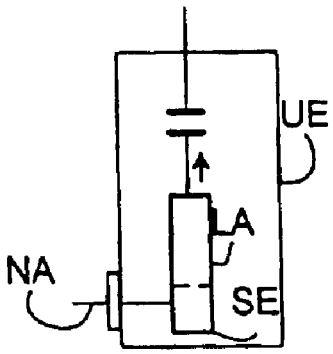
FIG. 3 shows an interrupter unit fully integrated in the linear drive.

The individual components of interrupter unit UE are brought together to a great extent in the exemplary embodiment of FIG. 3, in which linear motor drive LA having control unit SE is accommodated directly in the vacuum switch. Here too, necessary mains connection NA is led into the interior chamber of the vacuum switch via a gas-tight lead-in wire.

What is claimed is:

1. A drive arrangement, comprising:

a switchgear interrupter, the switchgear interrupter being a vacuum circuit breaker including a movable contact part;

a three-phase linear motor controlling the movable contact part, the three-phase linear motor including individual components that together form the three-phase linear motor and whose number and dimensions determine thrust and range of motion, the individual components including at least one of i) motor coils, and ii) parallel-operated motor modules;

a control unit that optimizes switching operations and regulates the three-phase linear motor, the control unit being provided with a mains connection; and a gas compartment, the interrupter unit, the three-phase linear motor drive and the control unit arranged together in the gas compartment.

2. A drive arrangement, comprising:

a switchgear interrupter, the switchgear interrupter being a vacuum circuit breaker including a movable contact part;

a three-phase linear motor controlling the movable contact part, the three-phase linear motor including individual components that together form the three-phase linear motor and whose number and dimensions determine thrust and range of motion, the individual components including at least one of i) motor coils, and ii) parallel-operated motor modules; and control unit that optimizes switching operations and regulates the three-phase linear motor, the control unit being provided with a mains connection;

wherein the three-phase linear motor drive is located in a vacuum chamber of the vacuum circuit breaker, and wherein the control unit is an integral component of the three-phase linear motor drive.

* * * * *